United States Patent [19]

Busch et al.

[11] Patent Number: 5,065,951

[45] Date of Patent: Nov. 19, 1991

[54] THREAD TUBE

[75] Inventors: Rainer Busch, Effretikon; Ludek Malina, Kloten, both of Switzerland

[73] Assignee: Maschinenfabrik Rieter AG, Winterthur, Switzerland

[21] Appl. No.: 507,964

[22] Filed: Apr. 11, 1990

[30] Foreign Application Priority Data

Apr. 14, 1989 [CH] Switzerland ..... 01412/89

[51] Int. Cl.[5] ..... B65H 49/34

[52] U.S. Cl. ..... 242/46.21; 242/118.3

[58] Field of Search ..... 242/46.21, 46.2, 46.4, 242/46.5, 46.6, 46.7, 118.3, 118.32; 57/129, 130

[56] References Cited

U.S. PATENT DOCUMENTS 210,358 11/1878 Rabbeth ..... 242/46.5
416,292 12/1889 Fowler ..... 242/46.7
686,446 11/1901 Draper ..... 242/46.7
4,428,541 1/1984 Novak ..... 242/46.2

FOREIGN PATENT DOCUMENTS 403590 6/1966 Switzerland .
653739 5/1951 United Kingdom .

*Primary Examiner*—Stanley N. Gilreath
*Attorney, Agent, or Firm*—M. Lawrence Oliverio

[57] ABSTRACT

A thread receiving tube for use in a high speed thread spinning machine having rotatably driven spindles mounted on the machine for effecting thread spinning, the tube comprising a hollow tubular body including at least at its upper end a stabilizing member, which grips into an axial aperture in the top of the spindle, the member comprising longitudinal downwardly extending lips which engage the inside surface of the axial aperture of the spindle.

7 Claims, 1 Drawing Sheet

THREAD TUBE

BACKGROUND OF THE INVENTION

The present invention relates to a thread receiving tube for mounting on a spindle in a thread spinning machine.

In the textile industry and in particular with thread spinning machines, new receiving tubes are used several times every day with each twisting/spinning mechanism on the machine. With conventional tubes, the only centering capability inheres in the lower end of the tube which is typically gripped against a cone of the spindle. More typically, spring loaded calotte shaped cams are provided on the spindle circumference at about 5/6 of the spindle height. Such cams may not adequately center the tube, as the springs can have variable manufacturing deviations. This type of gripping may sometimes be satisfactory at normal spindle rotational speeds of up to 22,000 rpm. The trend, however, is towards increased rotational speeds where further problems can arise. Calotte shaped cams have been flung out of an empty spindle by centrifugal force. On the one hand, this presents a danger to operating personnel and at the very least, the spindles may become imbalanced. In addition, repairs to the affected spindles may have to be effected, which under certain circumstances involves a complete shut down of an entire ring spinning machine. Further disadvantages are that the spring loading of calotte springs may be reduced due to the increased centrifugal force, such that the tubes may shake and may not be held correctly on a spindle also causing imbalance problems. Further as a result of the inherent elasticity of a typical tube material, the tube diameter portion which engages around a spindle cone widens, such that the gripping effect relaxes.

It is therefore an object of the present invention to provide a thread tube for use at high speeds which overcomes the previously mentioned disadvantages and which is engaged more firmly on a spindle at increasingly high rotational speeds, whereby more exact coaxial alignment may be maintained.

SUMMARY OF THE INVENTION

Preferably at least a portion of a tube lies inside an outer surrounding portion of the spindle configured to receive the inside tube portion. Through this, the gripping or engagement between the tube and the spindle becomes increasingly firmer with the widening of the diameter of the tube. As the inside portion of the tube is pressed against an outer surrounding portion of the spindle by centrifugal force or centripetal force, the coaxial position of the tube is better maintained. The tube is preferably engaged with the spindle, at least during rotation, in either the upper or lower end regions of the spindle and preferably both ends. The tube typically lies or inside and against a centering rim in the lower region of the tube provided as an outside opposing surface against the tube. Gripping by the tube can be increased through the formation of lips provided in the lower region of the tube. With an interrupted (or tooth like) centering rim, a self cleaning operation whereby fly and loose fibers may also be effected. Further, an outer protecting ring may be provided around the lips which protects the lower gripping lip region of the tube particularly when it is dropped.

The tube preferably includes a spigot in the upper region of the tube which is insertable into a circular axial central hole provided in the tip of the spindle. From a manufacturing point of view, a circular recess is preferred over a recess with a non-circular cross section, e.g. a rectangular cross section, although non-circular configurations may be utilized. When the spigots are made hollow and, in addition, lips are formed in the hollow spigots, then increasing gripping force can likewise be effected in the upper tube region. It is advantageous if the upper and lower lips are slightly angled outwards from the axis, such that manufacturing deviations may be compensated for and that a gripping force is also available when the spindle is stationary. Typically, the lips of the spigot and the inside portion of the lower end of a tube which is received by an outer rim on the spindle are provided with a suitable bevel to facilitate fitting on the spindle. A horizontal hole which cuts into the receiving hole for the spigots enables centrifuging of the fly collected therein. Most preferably the tube, together with the protecting ring, hollow spigots and gripping lips comprises a unitary piece of conventional resiliently rigid plastic material.

DETAILED DESCRIPTION OF EXEMPLARY EMBODIMENTS OF THE INVENTION

Figure 1:
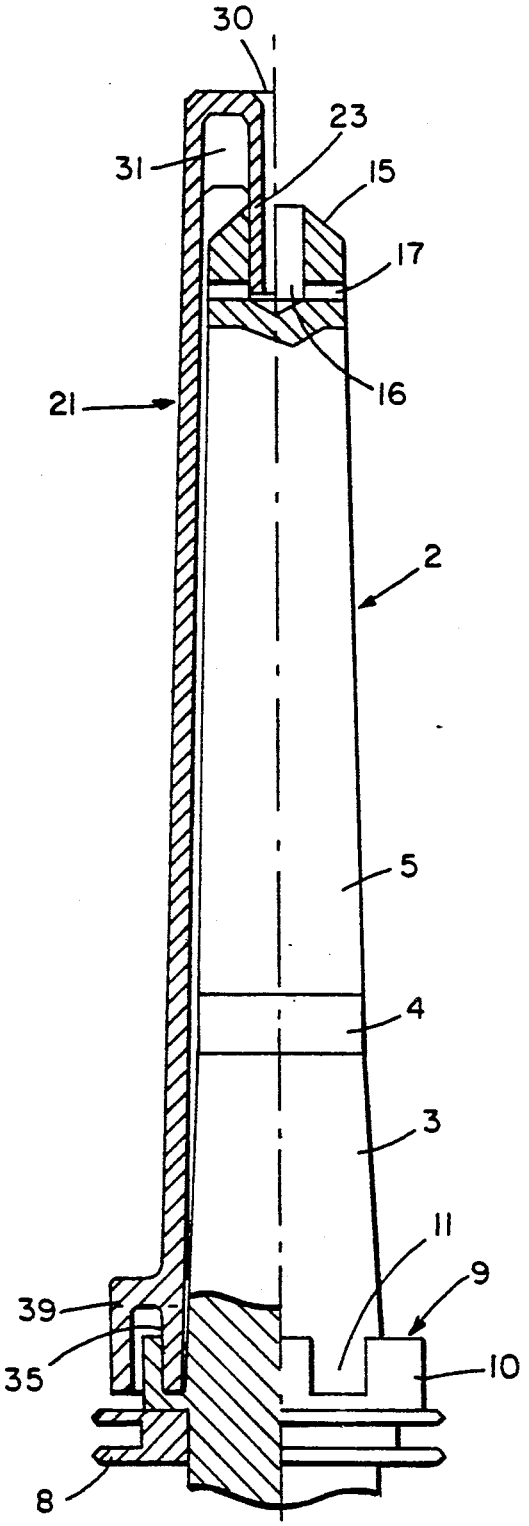
FIG. 1 is a side, partial cross sectional view of thread receiving tube according to the invention shown mounted on a receiving spindle; and, FIG. 2 is an isometric view of the spigot portion of the tube of FIG. 1.

As shown in FIG. 1, spindle 2 has a lower, slightly conical section 3, a middle cylindrical longitudinal section 4 and a slightly conical upper longitudinal section 5. An underwind crown 8 is also typically provided in applications where thread overwindings may occur during a doffing and donning operation. A centering rim, or crown 9, is disposed above the underwind crown 8 and the spindle 2. The centering rim 9 may be connected to the spindle 2 to form a unitary piece and preferably comprises evenly distributed partial rims 10 around the periphery of the rim 9, typically three or more. Fly and other waste can be ejected with an empty and rotating spindle 2 through the empty spaces 11 between the partial rims 10. A vertical hole 16, directed upwards, is located centrally in the tip 15 of the spindle 2. A horizontal hole 17 extends through the spindle 2 and enters into the hole 16 through which fly and other waste may be ejected when the tube is removed from the spindle.

As shown in FIG. 1 the tube 21 comprises a unitary body and is mounted on the spindle 2 and engaged at the top 15 and bottom portions of the spindle 2 in coaxial alignment therewith. For purposes of ease of illustration, one half of the tube 21 is illustrated in FIG. 1.

Figure 2:
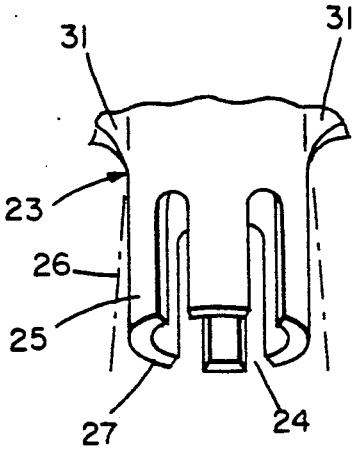

A hollow spigot portion 23 of the tube 2 is received within an axial aperture 16 provided in the tip of spindle 2. The spigot 23 comprises a series of downwardly extending lips 25 between which are a series of longitudinal openings 24. As shown in FIG. 1, the aperture 16 is complementary to spigot 23 such that when the spigot 23 is inserted into aperture 16, the lips 25 engage the inside surface of the aperture 16. When the spindle 2 is rotating, the lips 25 are forced against the inside surface of the aperture 16 by centrifugal force and the top portion of the tube 2 is thus more firmly gripped in coaxial alignment with the spindle 2 during rotation. Most preferably the lips 25, FIG. 2, are angled slightly outward by a few degrees (e.g. 1–5 degrees) relative to the longitudinal axis of the tube 2, such an exemplary outward angling designated by dashed lines 26 in FIG. 2. The spindle 2 is typically a unitary body comprised of a rigid resiliently deformable plastic material. With the lips 25 being angled slightly outwardly, when the spigot 23 is received within the aperture 16, the lips 25 engage the inside surfaces of aperture 16 with some amount of gripping force even when the spindle 2 is not rotating thus serving to maintain the tube in coaxial alignment with the spindle 2 during periods when the spindle is not rotating such as during donning and doffing operations. Because the lips 25 are slightly outwardly angled, the lowermost edges 27 of the lips 25 are provided with a bevel to facilitate introduction of the lips 25 into aperture 16 and overcome any difficulty in such insertion due to such angling 26.

Typically, the tube 21 is provided with a length 30 extending above the top surface of the spindle 2 thus providing clearance between the top surface 30 of the tube 21 and the top surface of the spindle 2. Most preferably, strengthening ribs 31 are also provided in the upper inside surface of the spigot 23 to stabilize the spigot 23 and lips 25 against opposing engagement forces with the aperture 16.

Lips 35, similar to lips 25 described with reference to FIG. 2, are also typically provided at the bottom end of tube 21. As shown in FIG. 1, lips 35 extend around the periphery of the tube 21 and are receivable within the annular aperture between rim 9 (comprising partial rims 10) and the body of spindle 2. When lips 35 are received within such aperture, lips 35 engage the inside surfaces of rims 10. Most preferably, lips 35 are provided with the same sort of slight outward angling as lips 25 and lower edge beveling such that when the tube 21 is mounted on spindle 2, the lips 35 exert some amount of engagement or gripping force against the rims 10 even when the spindle 2 is not rotating. The beveling of the lower outside edges of lips 35 is provided as for lips 25 to assist in overcoming any resistance to insertion of lips 35 behind rims 10 due to the outward angling. Also, as described with reference to lips 25 and aperture 16, when the spindle 2 is rotating the lips 35 are forced against the inside surfaces of rims 10 with increasing gripping or engagement force between the lower end of tube 21 and the spindle 2.

Further, in a most preferred embodiment, tube 21 is provided with an outer protecting ring 39 which surrounds and protects the lips 35 from damage especially against impact if the tube 21 is dropped.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. Apparatus for winding a thread in a spinning machine having a spindle drivably rotabable at high speed comprising:

a thread receiving tube comprising a hollow tubular body coaxially receivable on the spindle;

the hollow tubular body including a stabilizing member at the top and bottom ends thereof and the spindle including means for receiving the stabilizing members at the top and bottom ends thereof;

the stabilizing members having axially outwardly facing surfaces for engaging a complementary axially inwardly facing surface of the receiving means, the surfaces axially opposing each other when the tube is received on the spindle;

wherein the receiving means comprises an axial aperture in the top of the spindle for receiving the top stabilizing member of the hollow tubular body, the top stabilizing member being rigid and resiliently deformable such that the axially outwardly facing surface of the top stabilizing member engages the complementary axially inwardly facing surface of the axial aperture with increasing engagement force upon increasing high speed rotation of the spindle; and, wherein the receiving means comprises an upwardly projecting rim extending axially around the bottom of the spindle, for receiving the bottom stabilizing member of the hollow tubular body, the bottom stabilizing member being resiliently deformable such that the axially outwardly facing surface of the bottom stabilizing member engages the complimentary axially inwardly facing surface of the rim with increasing engagement force upon increasing high speed rotation of the spindle.

2. Apparatus for winding a thread at high speed in a thread spinning machine comprising:

a thread receiving tube and a spindle;

the thread receiving tube comprising a hollow tubular body coaxially receivable on the spindle;

the hollow tubular body including a stabilizing member at the top and bottom ends thereof;

the spindle including an axially central aperture in the top thereof for receiving the top stabilizing member and a means for receiving the bottom stabilizing member;

the stabilizing members having axially outwardly facing surfaces for engaging a complementary axially outwardly facing surface of the axial aperture and the receiving means, the surfaces axially opposing each other when the tube is received on the spindle;

wherein the top stabilizing member is rigid and resiliently deformable such that the outwardly facing surface of the top stabilizing member engages the complementary axially inwardly facing surface of the axial aperture with increasing engagement force upon increasing high speed rotation of the spindle, and, wherein the bottom stabilizing member is rigid and resiliently deformable such that the outwardly facing surface of the bottom stabilizing member engages the complementary axially inwardly facing surface of the receiving means with increasing engagement force upon increasing high speed rotation of the spindle.

3. A thread receiving tube for use in a thread spinning machine and spinning at high speed rotation comprising:

a hollow tubular body having an axis and a lower end, the tubular body being receivable through the lower end on a spindle rotatable at high speed;

the tubular body including downwardly projecting lips at its lower end which are rigid and resiliently deformable such that the lips resiliently deform outwardly upon increasing rotation of the tubular body around its axis.

4. The tube of claim 3 wherein the downwardly projecting lips are integral with the tubular body.

5. Apparatus for winding thread at high speed rotation in a thread spinning machine comprising:

a thread receiving tube and a spindle;

the tube having rigid and resiliently deformable downwardly projecting lips at a lower end of the tube;

the spindle having means for receiving the downwardly projecting lips, the lips of the tube being deformable outwardly to engage the means for receiving upon increasing rotation of the spindle.

6. The tube of claim 5 wherein the downwardly projecting lips are integral with the tube.

7. The tube of claim 5 wherein the downwardly projecting lips are angled outwardly a degree sufficient to bendably engage the means for receiving when the spindle is not rotating.

* * * * *